US008913767B2

(12) United States Patent
Onishi et al.

(10) Patent No.: US 8,913,767 B2
(45) Date of Patent: Dec. 16, 2014

(54) ELECTRO-ACOUSTIC TRANSDUCER, ELECTRONIC APPARATUS, ELECTRO-ACOUSTIC CONVERSION METHOD, AND SOUND WAVE OUTPUT METHOD OF ELECTRONIC APPARATUS

(75) Inventors: Yasuharu Onishi, Tokyo (JP); Shigeo Sato, Tokyo (JP); Jun Kuroda, Tokyo (JP); Yukio Murata, Tokyo (JP); Yuichiro Kishinami, Tokyo (JP); Nobuhiro Kawashima, Tokyo (JP); Motoyoshi Komoda, Tokyo (JP)

(73) Assignee: Lenovo Innovations Limited (Hong Kong), Quarry Bay (HK)

( * ) Notice: Subject to any disclaimer, the term of this patent is extended or adjusted under 35 U.S.C. 154(b) by 244 days.

(21) Appl. No.: 13/517,478

(22) PCT Filed: Dec. 17, 2010

(86) PCT No.: PCT/JP2010/007338

§ 371 (c)(1),
(2), (4) Date: Jun. 20, 2012

(87) PCT Pub. No.: WO2011/077683

PCT Pub. Date: Jun. 30, 2011

(65) Prior Publication Data

US 2012/0257772 A1 Oct. 11, 2012

(30) Foreign Application Priority Data

Dec. 24, 2009 (JP) ..... 2009-293460

(51) Int. Cl.

| | |
|---|---|
| ***H04R 25/00*** | (2006.01) |
| ***H04R 23/02*** | (2006.01) |
| ***H04R 17/00*** | (2006.01) |
| *H04R 9/06* | (2006.01) |

(52) U.S. Cl.

CPC ..... *H04R 23/02* (2013.01); *H04R 17/00* (2013.01); *H04R 9/06* (2013.01); *H04R 2499/11* (2013.01)

USPC ..... 381/190; 381/173; 381/412

(58) Field of Classification Search

CPC ..... H04R 17/00; H04R 7/04; H04R 23/02; H04R 2499/11; H04R 9/06; H04R 9/047; H04R 9/048

USPC ..... 381/173, 182, 190, 191, 399, 423, 424, 381/431; 310/324, 328, 330, 334

See application file for complete search history.

(56) References Cited

U.S. PATENT DOCUMENTS 4,242,541 A 12/1980 Ando
7,136,501 B2 * 11/2006 Steere et al. ..... 381/399

FOREIGN PATENT DOCUMENTS

JP 54-094020 7/1979
JP 56-149900 11/1981

(Continued)

OTHER PUBLICATIONS

International Search Report, PCT/JP2010/007338, Mar. 1, 2011.

(Continued)

*Primary Examiner* — Huyen D Le
(74) *Attorney, Agent, or Firm* — Young & Thompson

(57) ABSTRACT

There are provided a vibration film (21) having a piezoelectric element, a magnetic circuit (20) which generates magnetic force on the basis of a first electric signal and vibrates the vibration film (21) by the magnetic force; and an adjustment unit (31) which generates a second electric signal on the basis of the first electric signal and applies a voltage based on the second electric signal between both surfaces of the piezoelectric element. The amplitude of the entire vibration film (21) is expanded by making the vibration by the magnetic force, which is generated from the magnetic circuit (20), and the vibration, which is generated by application of a voltage to the piezoelectric element, synchronize with each other.

20 Claims, 14 Drawing Sheets

(56) References Cited

FOREIGN PATENT DOCUMENTS

| | | |
|---|---|---|
| JP | 57-099899 | 6/1982 |
| JP | 62-221300 | 9/1987 |
| JP | 63-176099 | 7/1988 |
| JP | 63-279700 | 11/1988 |
| JP | 08-088898 | 4/1996 |
| JP | 2003-259489 | 9/2003 |
| JP | 2005-110216 | 4/2005 |

OTHER PUBLICATIONS

Japanese Official Action—2011-527287—Sep. 24, 2014.

* cited by examiner

FIG. 12

| VIBRATION FILM THICKNESS | 50 | 100 | 200 | 300 | 500 |
|---|---|---|---|---|---|
| BASIC RESONANCE FREQUENCY | 914 | 954 | 1005 | 1075 | 1105 |
| MAXIMUM VIBRATION SPEED | 235 | 215 | 205 | 200 | 185 |
| SOUND PRESSURE LEVEL (1 KHz) | 94 | 91 | 88 | 87 | 86 |
| SOUND PRESSURE LEVEL (3 KHz) | 88 | 85 | 86 | 84 | 84 |
| SOUND PRESSURE LEVEL (5 KHz) | 92 | 95 | 87 | 85 | 84 |
| SOUND PRESSURE LEVEL (10 KHz) | 88 | 86 | 85 | 86 | 88 |
| FLATNESS OF FREQUENCY CHARACTERISTIC OF SOUND PRESSURE LEVEL | ○ | ○ | ○ | ○ | ○ |
| DROP IMPACT STABILITY | ○ | ○ | ○ | ○ | ○ |

ELECTRO-ACOUSTIC TRANSDUCER, ELECTRONIC APPARATUS, ELECTRO-ACOUSTIC CONVERSION METHOD, AND SOUND WAVE OUTPUT METHOD OF ELECTRONIC APPARATUS

TECHNICAL FIELD

The present invention relates to an electro-acoustic transducer which outputs sound waves by vibrating a vibration film on the basis of an electric signal, an electronic apparatus, an electro-acoustic conversion method, and a sound wave output method of an electronic apparatus.

BACKGROUND ART

Electrodynamic electro-acoustic transducers are used as acoustic components of electronic apparatuses, such as mobile phones. The electrodynamic electro-acoustic transducer is configured to include a permanent magnet, a voice coil, and a vibration film. The electrodynamic electro-acoustic transducer generates sound waves by vibrating the vibration film, such as an organic film, fixed to the voice coil, by operation of a magnetic circuit of a stator using a magnet.

In addition to the electrodynamic electro-acoustic transducer, an electro-acoustic transducer which uses piezoelectric ceramics for the vibration film is also known. In the electro-acoustic transducer, the piezoelectric ceramics with piezoelectric properties vibrate when an electric signal is applied to thereby generate sound waves.

A high-frequency-range limiting frequency in the electrodynamic electro-acoustic transducer is low, while the use of the electro-acoustic transducer using piezoelectric ceramics is limited to reproduction of high-pitched sound. Therefore, examples of an electro-acoustic transducer formed by combining both the electro-acoustic transducers are disclosed in Patent Documents 1 to 3.

The electro-acoustic transducer disclosed in Patent Document 1 has a structure where a piezoelectric element is bonded in the middle of a diaphragm. Since the piezoelectric element has a mass, inertial force acts to reduce a fundamental-mode frequency of the diaphragm. In addition, since the middle portion of the diaphragm, in which a piezoelectric element is bonded, and its periphery have different rigidities, a frequency of a secondary vibration mode becomes high due to piston movement by the piezoelectric element. For this reason, the electro-acoustic transducer disclosed in Patent Document 1 realizes an increase in the bandwidth of output sound waves.

The electro-acoustic transducer disclosed in Patent Document 2 also has a structure where a piezoelectric element is bonded in the middle of a diaphragm. By using the piezoelectric element for the treble region and the electrodynamic electro-acoustic transducer for the bass region, the electro-acoustic transducer disclosed in Patent Document 2 realizes an increase in the bandwidth of output sound waves.

The electro-acoustic transducer disclosed in Patent Document 3 has a structure where the piezoelectric body is provided in a duct cap of the electrodynamic electro-acoustic transducer. The electro-acoustic transducer disclosed in Patent Document 3 also realizes an increase in the bandwidth of output sound waves by using the piezoelectric body for the treble region and the electrodynamic electro-acoustic transducer for the bass region.

In addition, an example of a composite piezoelectric speaker is disclosed in Patent Document 4. The composite piezoelectric speaker disclosed in Patent Document 4 is a composite piezoelectric speaker with a diaphragm obtained by forming electrodes on upper and lower surfaces of the sheet-like composite piezoelectric body formed of flexible resin and a piezoelectric element, and the electrodes are formed of resin mixed with conductive powder. The characteristics in a high frequency band are improved by forming the electrodes themselves of the same material as for the composite piezoelectric body.

RELATED DOCUMENT

Patent Document

[Patent Document 1] Japanese Unexamined Patent Application Publication No. S 56-149900

[Patent Document 2] Japanese Unexamined Patent Application Publication No. S 57-99899

[Patent Document 3] Japanese Unexamined Patent Application Publication No. S 62-221300

[Patent Document 4] Japanese Unexamined Patent Application Publication No. H 08-088898

DISCLOSURE OF THE INVENTION

Incidentally, demand for portable terminals, such as mobile phones or laptop personal computers, has increased in recent years. Accordingly, demand for the miniaturization of the electro-acoustic transducer has increased.

The sound pressure level, which is an important index value in the sound performance of the electro-acoustic transducer, is determined by volume exclusion of the vibration film with respect to the air. Therefore, since the radiation surface area of the vibration film is reduced if the electro-acoustic transducer is made small, there has been a problem in that the sound pressure level is reduced. On the other hand, for improving the sound pressure level, there is a method of increasing the amplitude of the vibration film by increasing the force generated by the magnetic circuit. In this method, however, it is necessary to increase the magnetic flux density or to increase a driving current. In this case, there is a problem in that the thickness of a magnetic circuit is increased due to an increase in the volume of a permanent magnet or an increase in the thickness of a voice coil. In addition, there is also a problem in that power consumption increases with an increase in the amount of current. For this reason, there has been a problem in that it is difficult to improve a sound pressure level in a small electrodynamic electro-acoustic transducer.

The electro-acoustic transducers disclosed in Patent Documents 1 to 3 only realize an increase in the bandwidth of output sound waves by combining the piezoelectric body and the electrodynamic electro-acoustic transducer. Accordingly, the sound pressure level of a small electrodynamic electro-acoustic transducer is not improved. The composite piezoelectric speaker disclosed in Patent Document 4 improves high frequency characteristics, but does not improve the sound pressure level of a small electrodynamic electro-acoustic transducer.

Therefore, it is an object of the present invention to provide a small electro-acoustic transducer capable of improving the sound pressure level which is the problem described above.

An electro-acoustic transducer related to the present invention includes: a vibration film having a piezoelectric element; a magnetic circuit which generates magnetic force on the basis of a first electric signal and vibrates the vibration film by the magnetic force; and an adjustment unit which generates a second electric signal on the basis of the first electric signal and applies a voltage based on the second electric signal between both surfaces of the piezoelectric element.

An electronic apparatus related to the present invention includes the above-described electro-acoustic transducer mounted therein.

An electro-acoustic conversion method related to the present invention includes: vibrating a vibration film having a piezoelectric element by magnetic force generated on the basis of a first electric signal; generating a second electric signal on the basis of the first electric signal; and applying a voltage based on the second electric signal between both surfaces of the piezoelectric element.

An electro-acoustic conversion method of an electronic apparatus related to the present invention uses the above-described sound wave output method.

EFFECT OF THE INVENTION

The present invention can provide a small electro-acoustic transducer capable of improving the sound pressure level.

BRIEF DESCRIPTION OF THE DRAWINGS

The above-described object and other objects, features, and advantages will become more apparent by preferred embodiments described below and the following accompanying drawings.

FIG. 12 is a view illustrating the characteristics of an electro-acoustic transducer related to a fourth example of the present invention.

DESCRIPTION OF EMBODIMENTS

Figure 1:
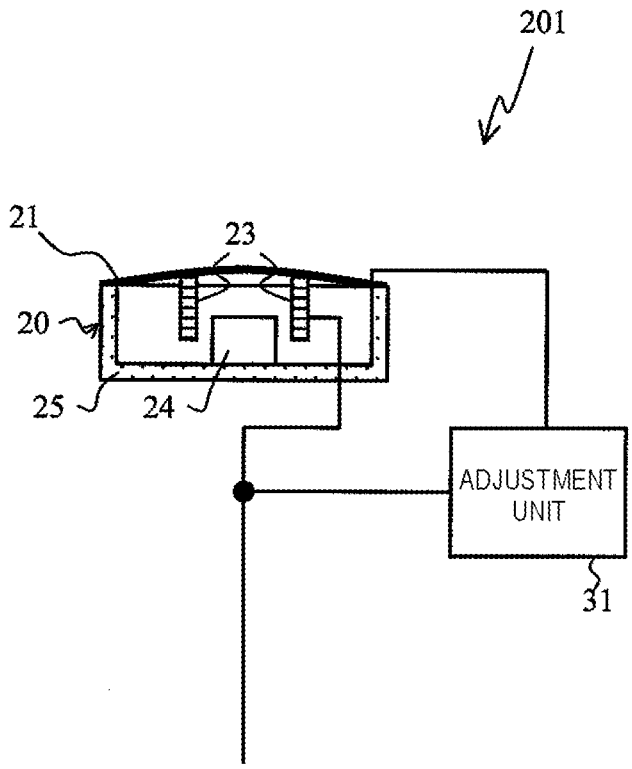
FIG. 1 is a sectional view showing an electro-acoustic transducer related to a first embodiment.

Embodiments of the present invention will be described with reference to the accompanying drawings. The embodiments described below are examples of the present invention, and the present invention is not limited to the following embodiments. In addition, it is assumed that components with the same reference numerals in this specification and drawings are the same.

A vibration film of an electro-acoustic transducer related to the present invention has not only a function for propagation of the vibration of a magnetic circuit but also a function of expanding the vibration amplitude. For example, the amplitude of the entire vibration film is expanded by making the vibration by magnetic force, which is generated from a magnetic circuit, and the vibration, which is generated by application of a voltage to a piezoelectric element, have the same phase, so that it is possible to obtain a larger sound pressure level than that in an electro-acoustic transducer configured to include a vibration film with no piezoelectric element. This will be described in detail in the following embodiments.

First Embodiment

FIG. 1 is a sectional view showing an electro-acoustic transducer 201 related to a first embodiment. The electro-acoustic transducer 201 includes: a vibration film 21 having a piezoelectric element 50 (refer to FIG. 4); a magnetic circuit 20 which generates magnetic force on the basis of a first electric signal and vibrates the vibration film 21 by the magnetic force; and an adjustment unit 31 which generates a second electric signal on the basis of the first electric signal and applies a voltage based on the second electric signal between both surfaces of the piezoelectric element 50.

Figure 2:
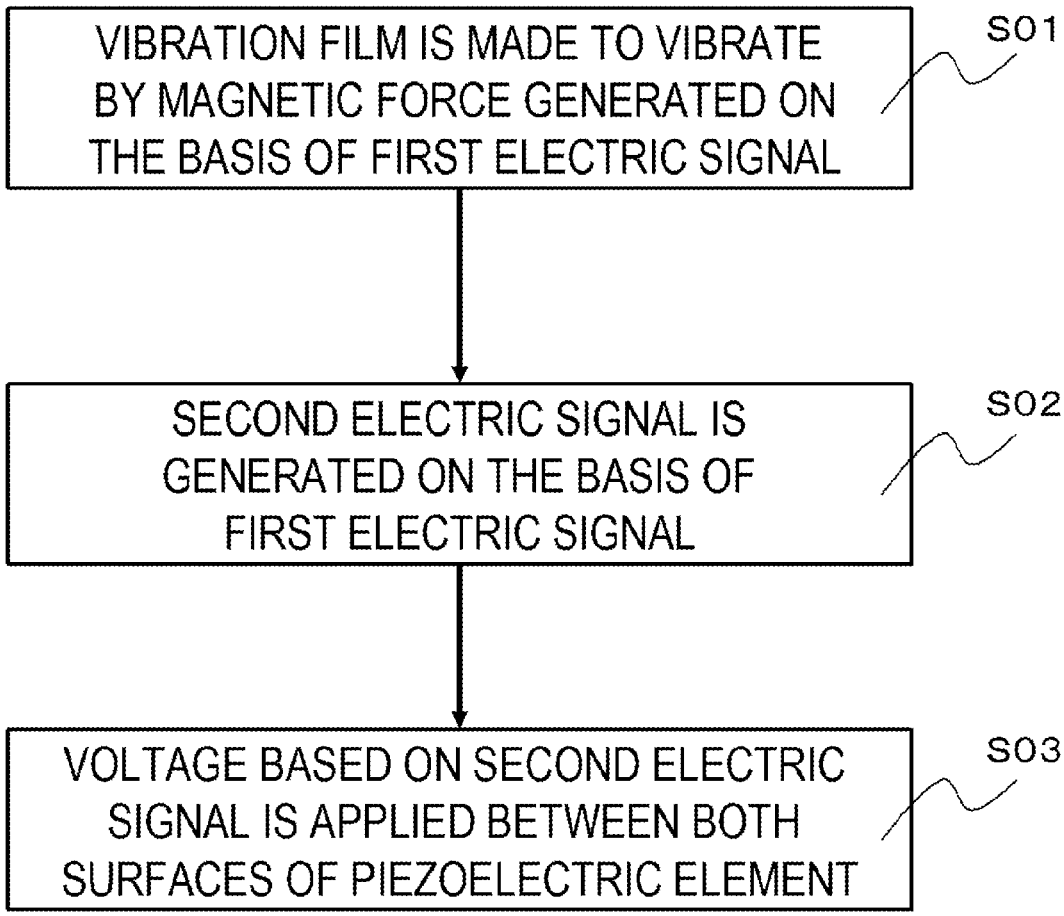
FIG. 2 is a flow chart illustrating an electro-acoustic conversion method related to the first embodiment.

FIG. 2 is a flow chart illustrating an electro-acoustic conversion method related to the first embodiment. The electro-acoustic transducer 201 performs an electro-acoustic conversion method of vibrating the vibration film 21 having the piezoelectric element 50 with the magnetic force generated on the basis of the first electric signal (step S01), generating the second electric signal on the basis of the first electric signal (step S02), and applying a voltage based on the second electric signal between both surfaces of the piezoelectric element 50 (step S03).

In FIG. 1, the magnetic circuit 20 includes a permanent magnet 24, a voice coil 23, and a frame 25. When the first electric signal is input to the voice coil 23, the voice coil 23 vibrates in response to the magnetic field formed by the permanent magnet. One end of the voice coil 23 is connected to the vibration film 21, and the vibration film 21 vibrates in response to vibration of the voice coil 23. The electro-acoustic transducer 201 can output sound waves by vibration of the vibration film 21.

The vibration film 21 has the piezoelectric element 50, and expands and contracts by piezoelectric force generated by a voltage based on the input second electric signal. By generating the vibration propagated from the magnetic circuit 20 and the vibration (expansion and contraction movement by the piezoelectric effect), which is generated by applying a voltage based on the second electric signal to the vibration film 21, simultaneously, the amplitude of the entire vibration film 21 expands. For example, if the adjustment unit 31 inputs the second electric signal so that the vibration from the magnetic circuit 20 and the vibration of the vibration film 21 by the piezoelectric effect have the same phase, the amplitude of the vibration film 21 is expanded, and a large sound pressure level can be obtained. In addition, if the adjustment unit 31 inputs the second electric signal so that the phase of the vibration of the vibration film 21 by the piezoelectric effect are controlled in conjunction with a specific frequency of the vibration from the magnetic circuit 20 based on the first electric signal, it is possible to suppress the split vibration which is a cause of a peak and trough in the acoustic characteristic. As a result, it is possible to obtain a large sound pressure level and also to reproduce flat sound in a wide frequency band. That is, the sound pressure level of the electro-acoustic transducer can be improved by generating the second electric signal on the basis of the first electric signal input to the magnetic circuit 20 and applying the voltage based on the second electric signal between both surfaces of the piezoelectric element.

Thus, since the vibration film 21 has the piezoelectric element 50 and the adjustment unit 31 applies a voltage based on the second electric signal so as to adjust the vibration of the vibration film 21, the electro-acoustic transducer 201 can improve the sound pressure level while reducing the size.

Second Embodiment

Figure 3:
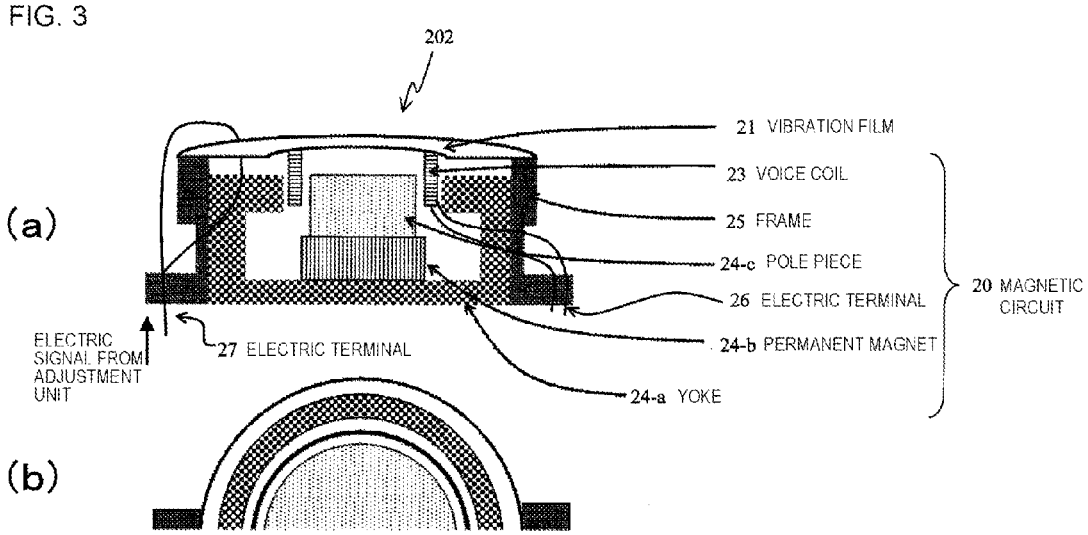
FIG. 3 is a sectional view and a top view showing an electro-acoustic transducer related to a second embodiment.

An electro-acoustic transducer 202 of the present embodiment will be described in more detail using FIG. 3. In FIG. 3, the adjustment unit 31 is not shown. FIG. 3 is a sectional view and a top view showing the electro-acoustic transducer 202 related to a second embodiment. FIG. 3(*a*) is a sectional view of the electro-acoustic transducer 202. FIG. 3(*b*) is a top view of the electro-acoustic transducer 202. The electro-acoustic transducer 202 includes a vibration film 21, a voice coil 23 fixed to one surface of the vibration film 21, a magnetic circuit 20 having a magnetic space where a lower end portion of the voice coil 23 is housed, a frame 25 which fixes and supports the magnetic circuit 20 and the vibration film 21, and an electric terminal 26 to which a first electric signal is input.

The voice coil 23 is an air core coil obtained by regular winding the coil winding, which is an enamel copper wire, in a circular shape, and fixing it with a coating material. A lower end portion fits in a space between a pole piece 24-*c* and a yoke 24-*a*, and an upper end portion is bonded to the vibration film 21.

The yoke 24-*a* is bonded and fixed to one surface of the permanent magnet 24-*b* magnetized in the thickness direction of the electro-acoustic transducer 202 and the pole piece 24-*c* is bonded to the other surface of the permanent magnet 24-*b*, thereby forming the magnetic circuit 20 together with the voice coil 23 passing through a space between an upper end portion of the yoke 24-*a* and a peripheral portion of the pole piece 24-*c*.

The frame 25 is bonded to the yoke 24-*a* and a peripheral portion of the vibration film 21 and accordingly, serves as a case of the electro-acoustic transducer 202. A resin material is used as a material of the frame 25. The electric terminal 26 is formed by soldering an external connection terminal and a winding terminal of the voice coil 23, and a compression coil spring is used as the external connection terminal. In addition, an electric terminal 27 is bonded to an upper electrode layer 51 and a lower electrode layer 52 (refer to FIG. 4) formed on upper and lower surfaces of the piezoelectric element 50.

Figure 4:
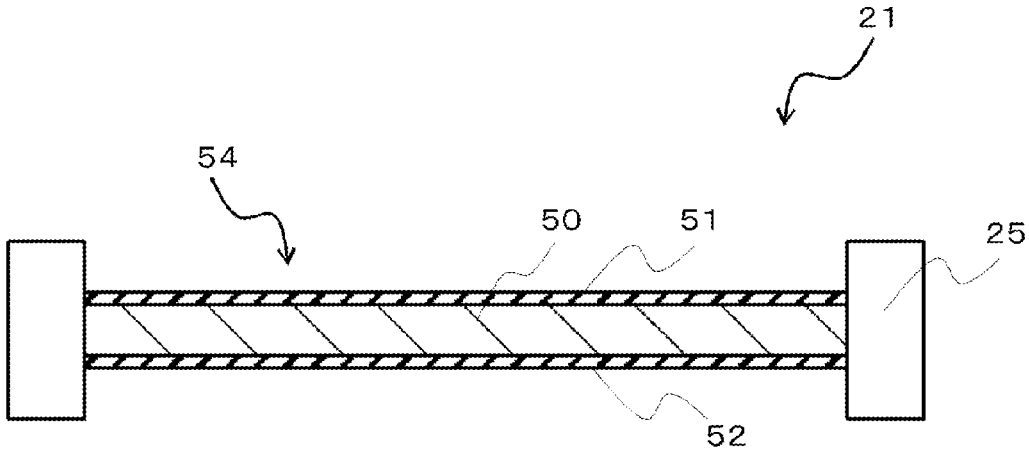
FIG. 4 is a sectional view showing a vibration film shown in FIG. 3.

FIG. 4 is a sectional view showing the vibration film 21 shown in FIG. 3. The vibration film 21 has a sheet-like piezoelectric element 50. It is a film member for increasing the vibration transmitted from the voice coil 23 and has a function as a radiation member which generates sound waves. The material of the piezoelectric element 50 is not particularly limited if it is a functional material showing the piezoelectric properties. For example, the piezoelectric element 50 is formed of a piezoelectric polymer material. As the piezoelectric polymer material, a piezoelectric polymer film, such as a polyvinylidene fluoride (PVDF), may be mentioned, for example. In addition, the piezoelectric element 50 may be formed of a piezoelectric ceramic material, for example.

Figure 9:
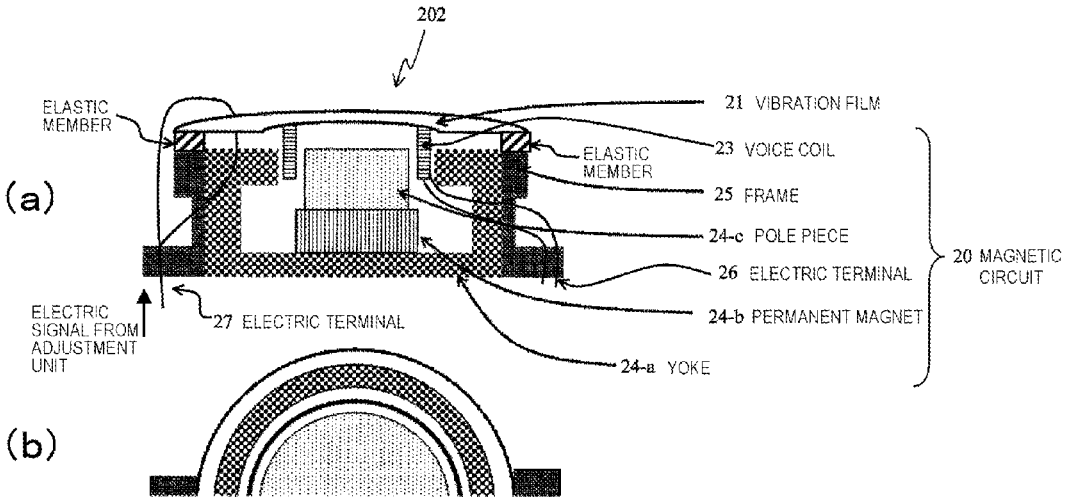
FIG. 9 is a sectional view and a top view showing an electro-acoustic transducer related to a third example of the present invention.
Figure 10:
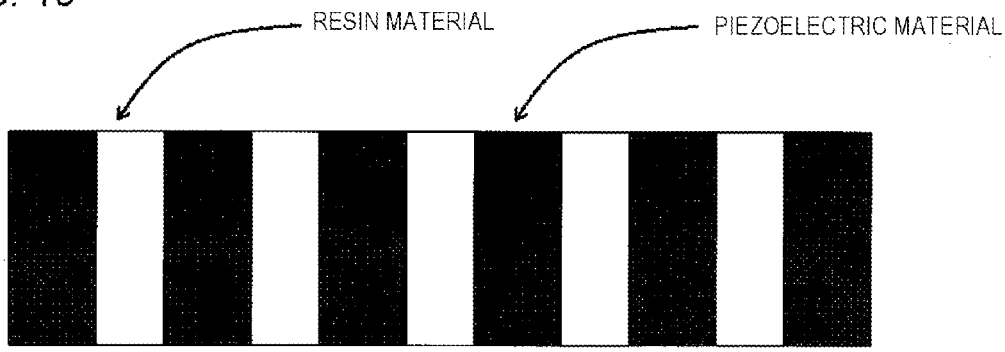
FIG. 10 is a view illustrating a vibration film of an electro-acoustic transducer related to a sixth example of the present invention.

For example, the vibration film 21 is formed by a piezoelectric transducer 54 including the piezoelectric element 50, the upper electrode layer 51, and the lower electrode layer 52. In this case, the edge of the piezoelectric transducer 54 is directly supported by the frame 25. In addition, as shown in FIG. 9 which will be described later, the vibration film 21 may be supported by the frame 25 through an elastic member. The upper electrode layer 51 and the lower electrode layer 52 are formed on the main surfaces of the top and bottom of the piezoelectric element 50. Although the polarization direction of the piezoelectric element 50 is not particularly limited, it is a thickness direction of the piezoelectric element 50, for example. The piezoelectric transducer 54 may be formed by forming the upper electrode layer 51 and the lower electrode layer 52 on the main surfaces of the top and bottom of a composite film formed by distributing piezoelectric ceramics inside a resin sheet as shown in FIG. 10, which will be described later.

The vibration film 21 performs expansion and contraction movement in a radial direction (radially spreading movement), such as simultaneous expansion or contraction of both the main surfaces, when an AC voltage is applied to the upper electrode layer 51 and the lower electrode layer 52 to give an AC electric field. In other words, the vibration film 21 performs expansion and contraction movement such that a first deformation mode, in which the main surface expands, and a second deformation mode, in which the main surface contracts, are repeated. In this case, since the edge of the vibration film 21 is fixed by the frame 25, the vibration film 21 repeats a convex deformation mode and a concave deformation mode. By applying a voltage to the piezoelectric element 50 in this way, vibration in a vertical direction occurs in the vibration film 21. Preferably, the thickness of the piezoelectric element 50 is set to be equal to or larger than 10 μm and equal to or smaller than 500 μm, for example. In particular, when the piezoelectric element 50 is a flat sheet material, it is preferable that the thickness of the piezoelectric element 50 be set to be equal to or larger than 20 μm and equal to or smaller than 200 μm. When the thickness of the piezoelectric element 50 is smaller than 10 μm, a thickness variation within the surface occurs, and this reduces the manufacturing stability. In addition, when the thickness of the piezoelectric element 50 exceeds 500 μm, the rigidity increases, and this reduces the vibration amplitude.

When the first electric signal is input to the electric terminal 26, a current flows through the voice coil 23, and magnetic force is generated in the voice coil 23 according to the Fleming's left hand rule. As a result, the vibration film 21 vibrates. On the other hand, when the second electric signal is input to the electric terminal 27, a voltage based on the second electric signal is applied to the piezoelectric element 50 of the vibration film 21. As a result, the vibration film 21 vibrates in the vertical direction. That is, the vibration of the vibration film 21 can be adjusted by two electric signals of the first electric signal input to the electric terminal 26 and the second electric signal input to the electric terminal 27.

Here, the amount of vibration of the entire vibration film 21 is increased and the sound pressure level is increased by adjusting the second electric signal input to the electric terminal 27 by the adjustment unit 31 so that the vibration of the vibration film 21 itself by the voltage based on the second electric signal has the same phase as the vibration by the magnetic force generated from the magnetic circuit 20 based on the first electric signal. For this reason, the electro-acoustic transducer 202 can obtain a larger sound pressure level than in an electro-acoustic transducer configured to include a vibration film with no piezoelectric element 50.

The adjustment unit 31 may adjust the vibration of a plurality of places of the vibration film 21 with piezoelectric force. That is, the adjustment unit 31 may be configured to apply the same voltage or different voltages based on second electric signals to a plurality of different portions in the piezoelectric element 50. For example, as shown in FIG. 10 which will be described later, the vibration film 21 may also be formed by the piezoelectric element 50 which is formed by arraying a plurality of piezoelectric materials so as to be separated from each other. In this case, the upper electrode layer 51 and the lower electrode layer 52 are formed in each of the plurality of piezoelectric materials. The adjustment unit 31 can adjust the vibration of the vibration film 21 finely within the surface by inputting the same or different second electric signals to the piezoelectric materials. Accordingly, since the phase of vibration of each portion within the surface of the vibration film 21 is adjusted by application of voltages based on second electric signals, it is possible to suppress the split vibration generated on the vibration film 21. As a result, flattening of the frequency characteristic of the sound pressure level can be realized.

Figure 14:
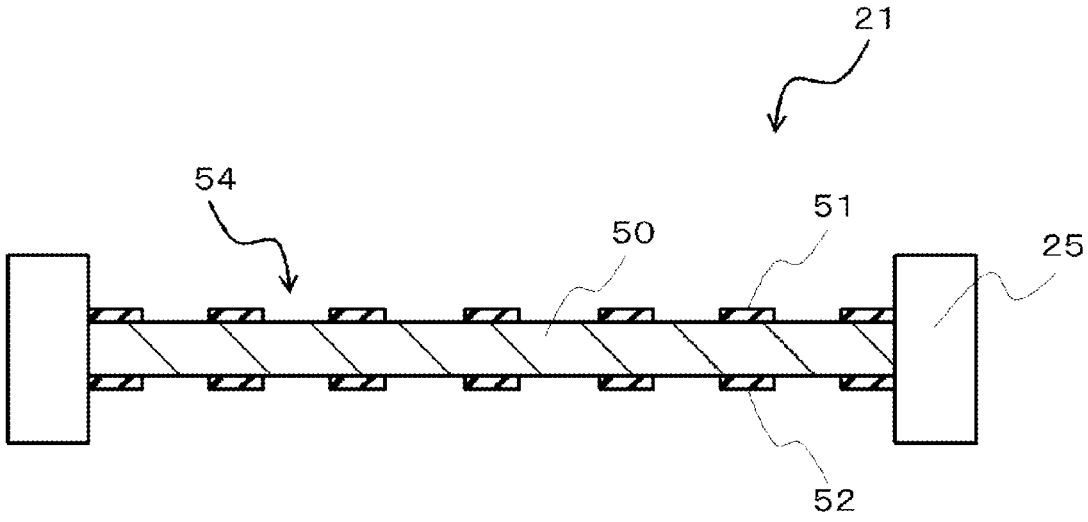
FIG. 14 is a sectional view showing a modification of the vibration film shown in FIG. 4.

In addition, FIG. 14 is a sectional view showing a modification of the vibration film 21 shown in FIG. 4. As shown in FIG. 14, the upper electrode layer 51 and the lower electrode layer 52 separated from each other may be formed in each portion within the surface of the piezoelectric element 50 consists of a piezoelectric material, and the phase of vibration of each portion within the surface of the vibration film 21 may be adjusted by inputting the same or different second electric signals to the upper electrode layer 51 and the lower electrode layer 52.

Figure 5:
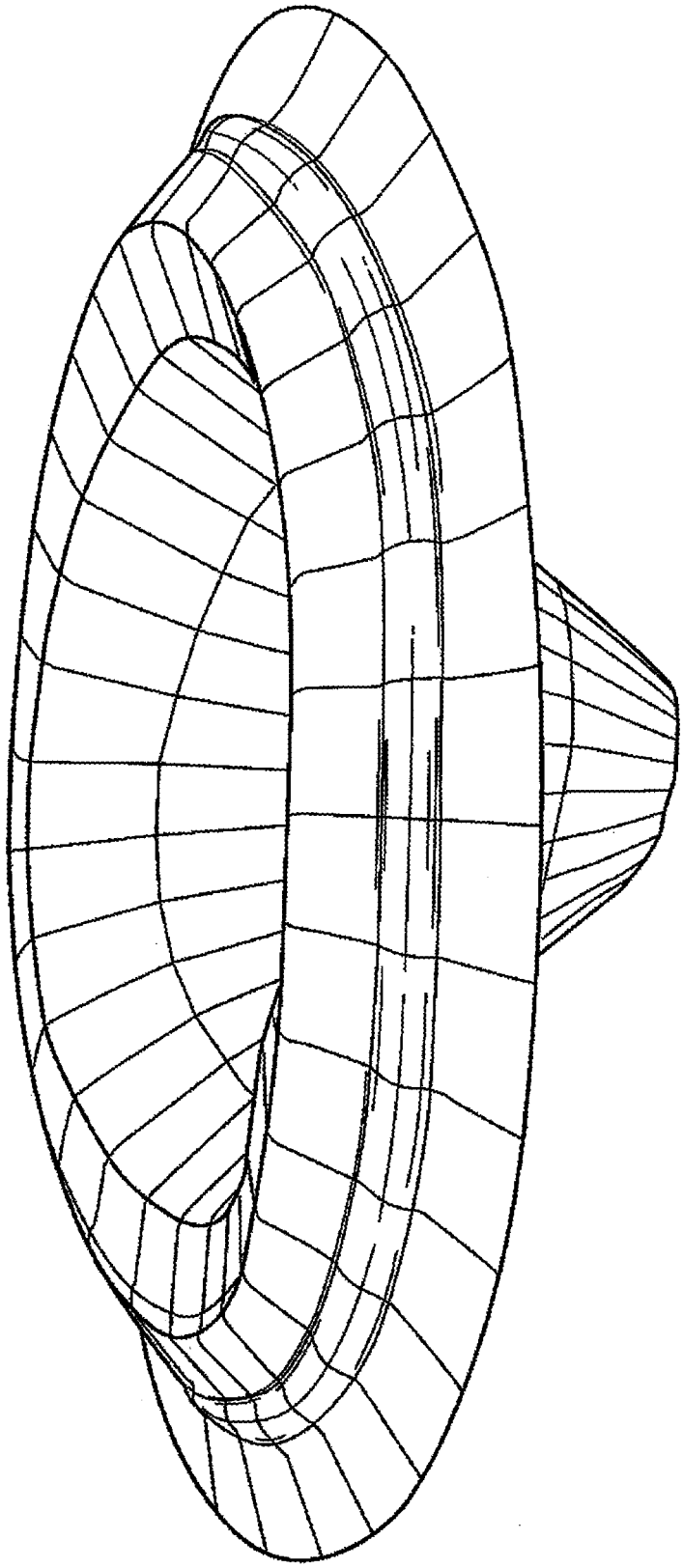
FIG. 5 is a schematic diagram illustrating the split vibration generated on the surface of a vibration film.
Figure 6:
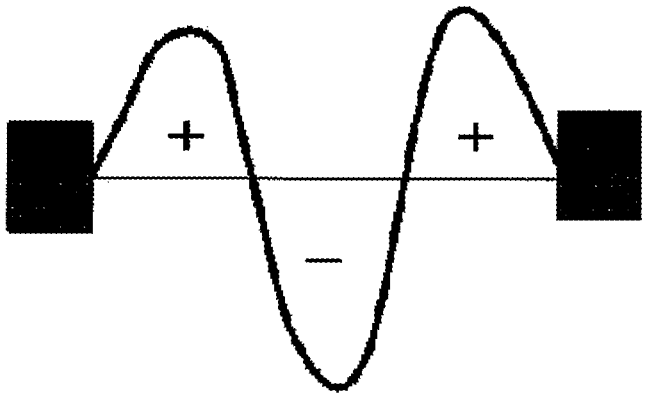
FIG. 6 is a schematic diagram illustrating the split vibration generated on the surface of a vibration film.

Next, the relationship between the split vibration and the acoustic characteristic and a method of adjusting the vibration form in the vibration film 21 will be described in detail. FIGS. 5 and 6 are schematic views illustrating the split vibration generated on the surface of the vibration film 21. The split vibration is formed because high-order modes of vibration generated after the basic resonance frequency overlap. As shown in FIG. 5, a number of vibration modes in which upside-down movement is performed are mixed within the radiation surface. At the time of this vibration, the efficiency of conversion from an input electric signal to vibration changes significantly before and after a frequency which generates split vibration, unlike piston movement in which the entire surface performs translational motion in the same direction (vibration mode occurring at the basic resonance frequency). This causes vibration other than an electric signal. When the vibration other than an electric signal occurs, sound may not be reproduced at a specific frequency, the sound may be emphasized, or reproduced sound may be distorted. This becomes the cause of undulation in the sound pressure level frequency characteristic (peak and trough in the acoustic characteristic).

For example, in the split vibration shown in FIG. 6, a vibration form is formed in which vibration modes with different phases (for example, a same phase and an opposite phase) are regularly mixed. In the acoustic radiation in this split vibration, phase interference between the vibration modes with different phases mixed within the radiation surface occurs, and the radiated sound is canceled. Accordingly, the sound pressure is attenuated to generate a dip in the frequency characteristic of the sound pressure level. For this reason, suppressing the split vibration was an essential task in order to realize flattening of the sound pressure level frequency.

Therefore, the adjustment unit 31 adjusts the phase of vibration of the vibration film 21 by applying a voltage together with the vibration form of the vibration film 21 by the magnetic force generated from the magnetic circuit 20. The vibration form of the vibration film 21 can be adjusted by overlapping or canceling the vibration by the magnetic force based on the first signal and the vibration by the voltage based on the second signal. As a result, since canceling of the radiated sound at the time of split vibration is suppressed, flattening of the frequency characteristic of the sound pressure level can be realized.

As described above, the electro-acoustic transducer (201, 202) uses the vibration film 21 having the piezoelectric element 50 which performs expansion and contraction movement according to the state of the electric field. As a result, the following effects are obtained. A different vibration source from the vibration by the magnetic force generated from the magnetic circuit 20 can be formed by the piezoelectric force based on the piezoelectric properties of the piezoelectric element 50. Accordingly, the amount of amplitude of the vibration film is increased by synchronizing the vibration by the magnetic circuit and the vibration, which is generated by the piezoelectric effect of the piezoelectric element. As a result, the sound pressure level is improved. In addition, the peak and trough in the acoustic characteristic can be suppressed by controlling the phase of vibration by the magnetic circuit and the phase of vibration by the piezoelectric effect of the piezoelectric element in conjunction with a specific frequency in the vibration film. Accordingly, it is possible to reproduce flat sound in a wide frequency band.

Third Embodiment

Figure 13:
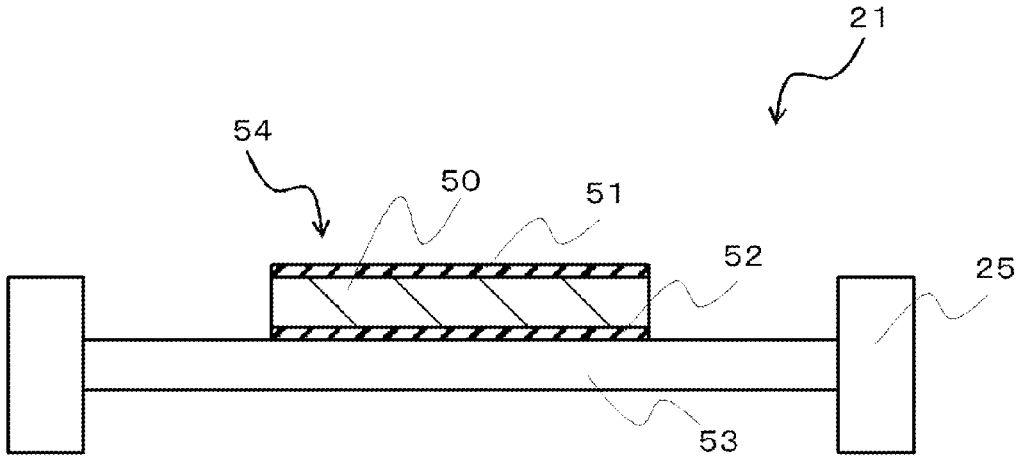
FIG. 13 is a sectional view showing a vibration film related to a third embodiment.

FIG. 13 is a sectional view showing the vibration film 21 related to a third embodiment. The electro-acoustic transducer related to the third embodiment is the same as the electro-acoustic transducer related to the second embodiment except for the configuration of the vibration film 21. The vibration film 21 related to the third embodiment is formed by a piezoelectric transducer 54, in which the upper electrode layer 51 and the lower electrode layer 52 are formed on the upper and lower main surfaces of the piezoelectric element 50, and a vibration member 53 which restrains the entire surface of the piezoelectric transducer 54, for example. In addition, the edge of the vibration member 53 is supported by the frame 25.

The vibration member 53 is formed of metal, resin, or the like. For example, the vibration member 53 is formed of a general-purpose material, such as phosphor bronze or stainless steel. Preferably, the thickness of the vibration member 53 is 5 to 500 μm. Moreover, preferably, the longitudinal elastic modulus of the vibration member 53 is 1 to 500 GPa. When the longitudinal elastic modulus of the vibration member 53 is too low or high, it may impair the characteristics or the reliability as a mechanical vibrator.

The vibration film 21 related to this modification generates vibration as follows by applying a voltage. Also in this modification, when an AC voltage is applied to the upper electrode layer 51 and the lower electrode layer 52, the piezoelectric element 50 performs expansion and contraction movement in the radial direction. However, the vibration member 53 which restrains the piezoelectric transducer 54 does not expand and contract. This may warp the vibration film 21 repeatedly. In this way, vibration occurs in the vibration film 21.

Also in this modification, the same effects as in the second embodiment can be obtained.

(Embodiment of an Electronic Apparatus in which an Electro-Acoustic Transducer is Mounted)

Figure 7:
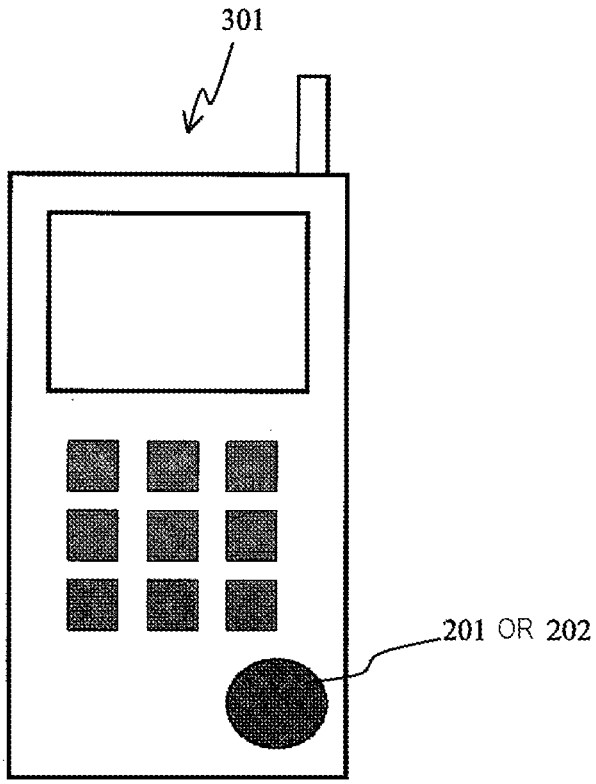
FIG. 7 is a view illustrating an electronic apparatus in which the electro-acoustic transducer is mounted.

FIG. 7 is a view illustrating an electronic apparatus in which the electro-acoustic transducer 201 in FIG. 1 or the electro-acoustic transducer 202 in FIG. 3 is mounted. The electronic apparatus in FIG. 7 is a mobile phone 301. The electro-acoustic transducer (201, 202) may be used as a sound wave output unit of an electronic apparatus (for example, a mobile phone, a laptop personal computer, a small games machine, and the like). In the electro-acoustic transducer of the present embodiment, only the material of the vibration film is changed. Accordingly, since the acoustic characteristic is improved without increasing the shape of the entire electro-acoustic transducer, the electro-acoustic transducer of the present embodiment may also be appropriately used for a portable electronic apparatus.

EXAMPLES (Evaluation Items)

The characteristics of the electro-acoustic transducer 202 were evaluated through the following evaluation items of evaluation 1 to evaluation 5.

(Evaluation 1) Measurement of a Basic Resonance Frequency

A basic resonance frequency when an AC voltage of 1 V was input was measured.

(Evaluation 2) Measurement of Frequency Characteristic Of Sound Pressure Level

The sound pressure level when an AC voltage of 1 V was input was measured by a microphone placed at the position separated by a predetermined distance from the device. In addition, this predetermined distance was set to 10 cm unless particularly described, and the frequency measurement range was set to 10 Hz to 10 kHz.

(Evaluation 3) Flatness Measurement of Frequency Characteristic of Sound Pressure Level The sound pressure level when an AC voltage of 1 V was input was measured by a microphone placed at the position separated by a predetermined distance from the device. The frequency measurement range was set to 10 Hz to 10 kHz, and the flatness of the frequency characteristic of the sound pressure level in the measurement range of 2 kHz to 10 kHz was measured by the difference between the maximum sound pressure level Pmax and the minimum sound pressure level Pmin. As a result, O was recorded when the sound pressure level difference (difference between the maximum sound pressure level Pmax and the minimum sound pressure level Pmin) fell within 20 dB, and × was recorded when the sound pressure level difference was equal to or larger than 20 dB. This predetermined distance was set to 10 cm unless particularly described.

(Evaluation 4) Maximum Vibration Speed

The maximum vibration speed Vmax when an AC voltage of 1V was applied and at the time of resonance, is measured (refer to FIG. 6).

(Evaluation 5) Drop Impact Test

A dropping impact stability test was performed by natural dropping a mobile phone, in which an electro-acoustic transducer was mounted, 5 times from a vertical height of 50 cm. Specifically, breakage, such as cracks, after the drop impact test was visually inspected for, and the sound pressure characteristic after the test was measured. As a result, O was recorded when the sound pressure level difference (difference between the sound pressure level before the test and the sound pressure level after the test) fell within 3 dB, and × was recorded when the sound pressure level difference was equal to or larger than 3 dB.

First Example

The characteristics of the electro-acoustic transducer 202 were evaluated. The evaluation results were as follows.

Figure 11:
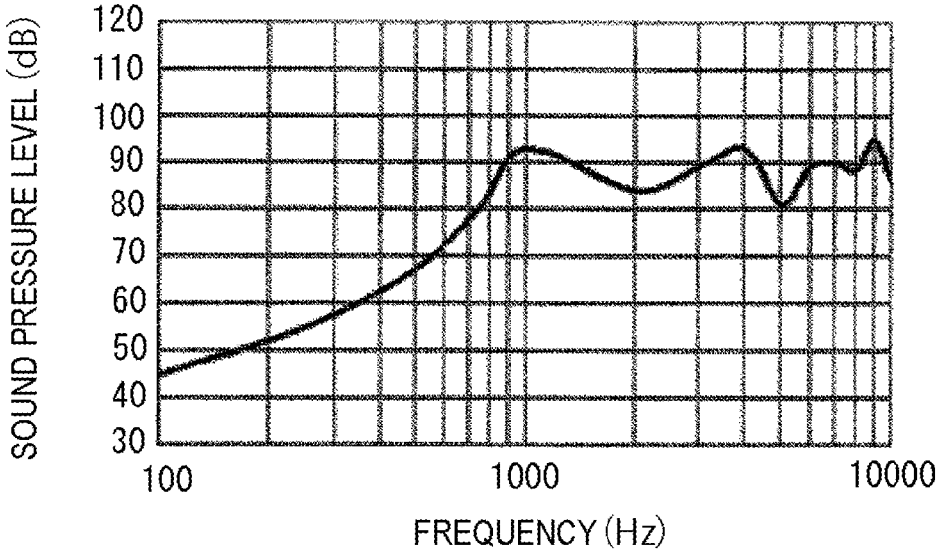
FIG. 11 is an acoustic characteristic diagram of the electro-acoustic transducer related to the present invention.

Basic resonance frequency: 954 Hz
Maximum vibration speed: 215 mm/s
Sound pressure level (1 kHz): 91 dB
Sound pressure level (3 kHz): 86 dB
Sound pressure level (5 kHz): 95 dB
Sound pressure level (10 kHz): 86 dB
Flatness of frequency characteristic of sound pressure level: O
Drop impact stability: O As is apparent from the above results, the frequency characteristic of the sound pressure level of the electro-acoustic transducer 202 is flat, and a large peak and trough in the acoustic characteristic is not observed. In addition, it was verified that the vibration amplitude was large when the basic resonance frequency was equal to or lower than 1 kHz and a sound pressure level exceeding 80 dB was obtained in a wide frequency band of 1 to 10 kHz. In addition, FIG. 11 is an acoustic characteristic diagram of the electro-acoustic transducer 202.

First Comparative Example

As a comparative example, an electro-acoustic transducer in which a vibration film was a PET film was manufactured. The configuration in this comparative example is the same as that in the first example except for the vibration film. The evaluation results were as follows.

Basic resonance frequency: 954 Hz
Maximum vibration speed: 185 mm/s
Vibration speed ratio: 0.79
Vibration form: curvature type
Sound pressure level (1 kHz): 77 dB
Sound pressure level (3 kHz): 75 dB
Sound pressure level (5 kHz): 76 dB
Sound pressure level (10 kHz): 97 dB
Flatness of frequency characteristic of sound pressure level: ×
Drop impact stability: ×

Second Example

Figure 8:
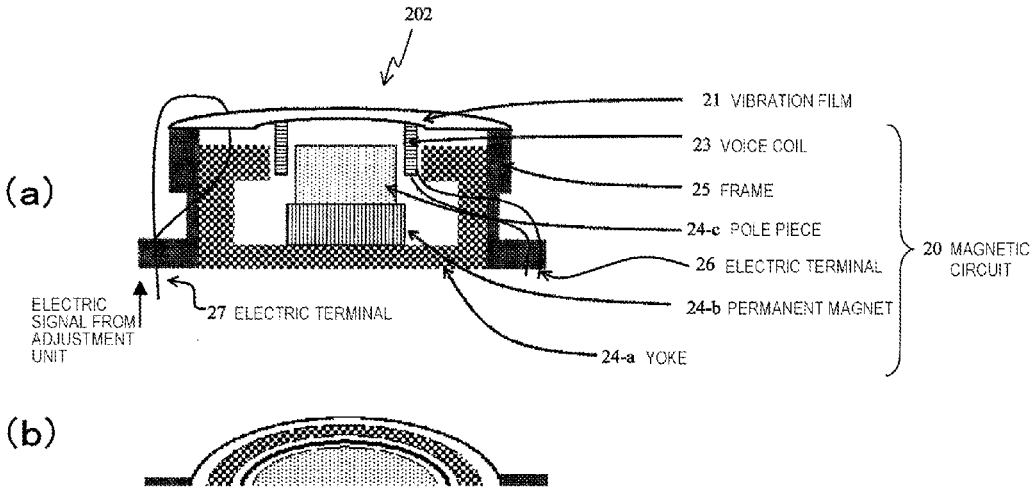
FIG. 8 is a sectional view and a top view showing an electro-acoustic transducer related to a second example of the present invention.

FIG. 8 is a sectional view and a top view showing an electro-acoustic transducer related to a second example of the present invention. FIG. 8(*a*) is a sectional view of the electro-acoustic transducer related to the second example. FIG. 8(*b*) is a top view of the electro-acoustic transducer related to the second example. In the electro-acoustic transducer in the second example, the contour shape of the vibration film 21 of the electro-acoustic transducer 202 is elliptic as shown in FIG. 8. The configuration in the second example is the same as that in the first example except for the contour of the vibration film. The evaluation results were as follows.

Basic resonance frequency: 921 Hz
Maximum vibration speed: 215 mm/s
Sound pressure level (1 kHz): 93 dB
Sound pressure level (3 kHz): 88 dB
Sound pressure level (5 kHz): 81 dB
Sound pressure level (10 kHz): 88 dB Flatness of frequency characteristic of sound pressure level: O Drop impact stability: O As is apparent from the above results, the electro-acoustic transducer in this example has the same characteristics as in the first example. Accordingly, the frequency characteristic of the sound pressure level is flat regardless of the contour shape of the electro-acoustic transducer, and a dip and a peak are not observed.

Third Example

FIG. 9 is a sectional view and a top view showing an electro-acoustic transducer related to a third example of the present invention. FIG. 9(*a*) is a sectional view of the electro-acoustic transducer related to the third example. FIG. 9(*b*) is a top view of the electro-acoustic transducer related to the third example. In the third example, a piezoelectric ceramic material (lead zirconate titanate (PZT)) was used for a vibration film. In addition, an elastic member (silicon-based elastomer) was interposed between a vibration film and a frame as shown in FIG. 9. The configuration in the third example is the same as that in the first example except for the material of the vibration film and interposition of the elastic member. The evaluation results were as follows.

Basic resonance frequency: 875 Hz

Maximum vibration speed: 305 mm/s

Vibration form: piston type

Sound pressure level (1 kHz): 106 dB

Sound pressure level (3 kHz): 97 dB

Sound pressure level (5 kHz): 108 dB

Sound pressure level (10 kHz): 110 dB

Flatness of frequency characteristic of sound pressure level: O

Drop impact stability: O

As is apparent from the above results, the electro-acoustic transducer in this example has the same characteristics as in the first example. Accordingly, if a material having the piezoelectric properties is used, the sound pressure level frequency characteristic is flat regardless of the material of the vibration film, and a dip and a peak are not observed.

Fourth Example

In a fourth example, the thickness of the vibration film of the electro-acoustic transducer 202 was changed. The configuration in the fourth example is the same as that in the first example except for the thickness of the vibration film. The evaluation results were the same as in FIG. 12. In addition, FIG. 12 is a view illustrating the characteristics of the electro-acoustic transducer related to the fourth example of the present invention. As is apparent from the results in FIG. 12, the electro-acoustic transducer in this example has the same characteristics as in the first example regardless of the thickness of the vibration film, and the frequency characteristic of the sound pressure level is flat.

Fifth Example

In the electro-acoustic transducer 202, the vibration film was driven with a different phase from the vibration by a magnetic circuit, and flattening of the frequency characteristic of the sound pressure level was verified. The evaluation results were as follows.

Basic resonance frequency: 954 Hz

Maximum vibration speed: 215 mm/s

Sound pressure level (1 kHz): 91 dB

Sound pressure level (3 kHz): 89 dB

Sound pressure level (5 kHz): 92 dB

Sound pressure level (10 kHz): 90 dB

Flatness of frequency characteristic of sound pressure level: O

Drop impact stability: O

As is apparent from the above results, according to this example, the same sound pressure level as in the first example was obtained by controlling the phase when driving the magnetic circuit and the vibration film. Therefore, it was verified that the frequency characteristic of the sound pressure level could be made flat.

Sixth Example

FIG. 10 is a view illustrating a vibration film of an electro-acoustic transducer related to a sixth example of the present invention. As the sixth example, a vibration film was used in which a resin material and a piezoelectric ceramic material were alternately distributed as shown in FIG. 10. The configuration in the sixth example is the same as that in the first example except for the material of the vibration film. The evaluation results were as follows.

Basic resonance frequency: 904 Hz

Maximum vibration speed: 215 mm/s

Sound pressure level (1 kHz): 94 dB

Sound pressure level (3 kHz): 89 dB

Sound pressure level (5 kHz): 95 dB

Sound pressure level (10 kHz): 91 dB

Flatness of frequency characteristic of sound pressure level: O

Drop impact stability: O

As is apparent from the above results, the electro-acoustic transducer in this example has the same sound pressure level as in the first example regardless of the material of the vibration film. Therefore, it was verified that the frequency characteristic of the sound pressure level could be made flat.

Seventh Example

As a seventh example, the mobile phone 301 in FIG. 7 was evaluated. The electro-acoustic transducer 202 was mounted in this housing. Specifically, this had a configuration in which the electro-acoustic transducer 202 was bonded to the inside surface of the housing of the mobile phone. As the evaluation method, the sound pressure level and the frequency characteristic were measured by a microphone placed at a position 10 cm away from the device. In addition, a drop impact test was also performed. The results were as follows.

Resonance frequency: 775 Hz

Sound pressure level (1 kHz): 85 dB

Sound pressure level (3 kHz): 84 dB

Sound pressure level (5 kHz): 89 dB

Sound pressure level (10 kHz): 86 dB

Drop impact test: cracking of the piezoelectric element was not observed ever after dropping 5 times, and the sound pressure level (1 kHz) measured after the test was 84 dB.

Flatness of frequency characteristic of sound pressure level: O (Note 1)

An electro-acoustic transducer including: a vibration film having a piezoelectric element; a magnetic circuit which generates magnetic force on the basis of a first electric signal and vibrates the vibration film by the magnetic force; and an adjustment unit which generates a second electric signal on the basis of the first electric signal and applies a voltage based on the second electric signal between both surfaces of the piezoelectric element.

(Note 2)

The electro-acoustic transducer described in Note 1 in which the adjustment unit applies voltages based on the same or different second electric signals to a plurality of different portions in the piezoelectric element.

(Note 3)

The electro-acoustic transducer described in Note 1 or 2 in which the adjustment unit generates the second electric signal such that vibration by a voltage based on the second electric signal has the same phase as vibration by the magnetic force based on the first electric signal.

(Note 4)

The electro-acoustic transducer described in Note 1 or 2 in which the adjustment unit generates the second electric signal such that vibration by a voltage based on the second electric signal has the opposite phase to vibration by the magnetic force based on the first electric signal.

(Note 5)

The electro-acoustic transducer described in any one of Notes 1 to 4 in which the piezoelectric element is formed of a piezoelectric polymer material.

(Note 6)

The electro-acoustic transducer described in any one of Notes 1 to 4 in which the piezoelectric element is formed of a piezoelectric ceramic material and is fixed to a frame of the magnetic circuit with an elastic member interposed therebetween.

(Note 7)

The electro-acoustic transducer described in any one of Notes 1 to 4 in which the piezoelectric element is a composite piezoelectric film formed by distributing piezoelectric ceramics inside a resin sheet.

(Note 8)

An electronic apparatus in which the electro-acoustic transducer described in any one of Notes 1 to 7 is mounted.

(Note 9)

An electro-acoustic conversion method including: vibrating a vibration film having a piezoelectric element by magnetic force generated on the basis of a first electric signal; generating a second electric signal on the basis of the first electric signal; and applying a voltage based on the second electric signal between both surfaces of the piezoelectric element.

(Note 10)

The electro-acoustic conversion method described in Note 9 in which voltages based on the same or different second electric signals are applied to different portions of the piezoelectric element.

(Note 11)

The electro-acoustic conversion method described in Note 9 or 10 in which the second electric signal is generated such that vibration by a voltage based on the second electric signal has the same phase as vibration by the magnetic force based on the first electric signal.

(Note 12)

The electro-acoustic conversion method described in Note 9 or 10 in which the second electric signal is generated such that vibration by a voltage based on the second electric signal has the opposite phase to vibration by the magnetic force based on the first electric signal.

(Note 13)

The electro-acoustic conversion method described in any one of Notes 9 to 12 in which the piezoelectric element is formed of a piezoelectric polymer material.

(Note 14)

The electro-acoustic conversion method described in any one of Notes 9 to 12 in which the piezoelectric element is formed of a piezoelectric ceramic material and is fixed to a frame of the magnetic circuit with an elastic member interposed therebetween.

(Note 15)

The electro-acoustic conversion method described in any one of Notes 9 to 12 in which the piezoelectric element is a composite piezoelectric film formed by distributing piezoelectric ceramics inside a resin sheet.

(Note 16)

A sound wave output method of an electronic apparatus using the electro-acoustic conversion method described in any one of Notes 9 to 15.

This application claims priority on the basis of Japanese Patent Application No. 2009-293460, filed on Dec. 24, 2009, the entire content of which are incorporated herein.

The invention claimed is:

1. An electro-acoustic transducer comprising:

a vibration film having a piezoelectric element;

a magnetic circuit which generates magnetic force on the basis of a first electric signal and vibrates the vibration film by the magnetic force; and an adjustment unit which generates a second electric signal on the basis of the first electric signal and applies a voltage based on the second electric signal between both surfaces of the piezoelectric element, wherein the magnetic circuit includes a pole piece, a yoke and a voice coil, and wherein the voice coil that has an upper end portion fixed to one surface of the vibration film and a lower end portion fits in a space between the pole piece and the yoke.

2. The electro-acoustic transducer according to claim 1, wherein the adjustment unit applies voltages based on the same or different second electric signals to a plurality of different portions in the piezoelectric element.

3. The electro-acoustic transducer according to claim 2, wherein the adjustment unit generates the second electric signal such that vibration by a voltage based on the second electric signal has the same phase as vibration by the magnetic force based on the first electric signal.

4. The electro-acoustic transducer according to claim 2, wherein the adjustment unit generates the second electric signal such that vibration by a voltage based on the second electric signal has the opposite phase to vibration by the magnetic force based on the first electric signal.

5. An electronic apparatus in which the electro-acoustic transducer according to claim 4 is mounted.

6. An electronic apparatus in which the electro-acoustic transducer according to claim 2 is mounted.

7. The electro-acoustic transducer according to claim 1, wherein the adjustment unit generates the second electric signal such that vibration by a voltage based on the second electric signal has the same phase as vibration by the magnetic force based on the first electric signal.

8. An electronic apparatus in which the electro-acoustic transducer according to claim 7 is mounted.

9. The electro-acoustic transducer according to claim 1, wherein the adjustment unit generates the second electric signal such that vibration by a voltage based on the second electric signal has the opposite phase to vibration by the magnetic force based on the first electric signal.

10. An electronic apparatus in which the electro-acoustic transducer according to claim 9 is mounted.

11. An electronic apparatus in which the electro-acoustic transducer according to claim 1 is mounted.

12. An electro-acoustic conversion method comprising:

vibrating a vibration film having a piezoelectric element by magnetic force generated from a magnetic circuit on the basis of a first electric signal;

generating a second electric signal on the basis of the first electric signal; and applying a voltage based on the second electric signal between both surfaces of the piezoelectric element, wherein the magnetic circuit includes a pole piece, a yoke and a voice coil, and wherein the voice coil that has an upper end portion fixed to one surface of the vibration film and a lower end portion fits in a space between the pole piece and the yoke.

13. The electro-acoustic conversion method according to claim 12, wherein voltages based on the same or different second electric signals are applied to different portions of the piezoelectric element.

14. The electro-acoustic conversion method according to claim 13, wherein the second electric signal is generated such that vibration by a voltage based on the second electric signal has the same phase as vibration by the magnetic force based on the first electric signal.

15. A sound wave output method of an electronic apparatus using the electro-acoustic conversion method according to claim 13.

16. The electro-acoustic conversion method according to claim 12, wherein the second electric signal is generated such that vibration by a voltage based on the second electric signal has the same phase as vibration by the magnetic force based on the first electric signal.

17. A sound wave output method of an electronic apparatus using the electro-acoustic conversion method according to claim 16.

18. The electro-acoustic conversion method according to claim 12, wherein the second electric signal is generated such that vibration by a voltage based on the second electric signal has the opposite phase to vibration by the magnetic force based on the first electric signal.

19. A sound wave output method of an electronic apparatus using the electro-acoustic conversion method according to claim 18.

20. A sound wave output method of an electronic apparatus using the electro-acoustic conversion method according to claim 12.

* * * * *